US011401630B2

(12) United States Patent
Rovellini

(10) Patent No.: US 11,401,630 B2
(45) Date of Patent: Aug. 2, 2022

(54) METHOD FOR SPREADING A TOW OF TEXTILE NON-BRAIDED FILAMENTS, PREFERABLY CHEMICAL OR INORGANIC FILAMENTS

(71) Applicant: M.A.E. S.P.A., Piacenza (IT)

(72) Inventor: Marco Rovellini, Piacenza (IT)

(73) Assignee: M.A.E. S.P.A., Piacenza (IT)

( * ) Notice: Subject to any disclaimer, the term of this patent is extended or adjusted under 35 U.S.C. 154(b) by 534 days.

(21) Appl. No.: 16/478,965

(22) PCT Filed: Mar. 27, 2018

(86) PCT No.: PCT/IB2018/052070
§ 371 (c)(1),
(2) Date: Jul. 18, 2019

(87) PCT Pub. No.: WO2018/178857
PCT Pub. Date: Oct. 4, 2018

(65) Prior Publication Data

US 2019/0352809 A1 Nov. 21, 2019

(30) Foreign Application Priority Data

Mar. 30, 2017 (IT) ..... 102017000035017

(51) Int. Cl.
*D02J 1/18* (2006.01)
*B65H 51/005* (2006.01)
(Continued)

(52) U.S. Cl.
CPC ..... *D02J 1/18* (2013.01); *B65H 51/005* (2013.01); *D01D 11/02* (2013.01); *D02J 1/20* (2013.01)

(58) Field of Classification Search
CPC .... D02J 1/18; D02J 1/20; D02J 1/223; D01D 11/02; B65H 51/005; B65H 2701/314;
(Continued)

(56) References Cited

U.S. PATENT DOCUMENTS 4,495,017 A * 1/1985 Abe ..... B29C 70/50 156/181
5,042,111 A * 8/1991 Iyer ..... D02J 1/18 19/65 T
(Continued)

FOREIGN PATENT DOCUMENTS

CN 1343274 A 4/2002
CN 101680136 A 3/2010
(Continued)

OTHER PUBLICATIONS

Russian Office Action dated Apr. 26, 2021 from counterpart Russian Pattent Application No. 201912070749/03.
(Continued)

*Primary Examiner* — Amy Vanatta
(74) *Attorney, Agent, or Firm* — Shuttleworth & Ingersoll, PLC; Timothy J. Klima

(57) ABSTRACT

A method for spreading a tow of textile non-braided filaments, preferably chemical or inorganic fibres comprises providing a tow of textile non-braided filaments extending along its own main direction and having a section transverse to the main direction with a predetermined thickness and a predetermined width, feeding the tow along a travel path and spreading the tow in order to increase its width and reduce its thickness, defining a spread tow. The step of spreading the tow includes immersing the tow in a bath and generating in the bath a sequence of transverse waves crossing the tow transversely to the main direction in order to separate and place the individual filaments side by side, thereby spread-
(Continued)

ing the tow, wherein the tow entering the bath and/or the spread tow extracted from the bath is/are unsized.

13 Claims, 2 Drawing Sheets

(51) Int. Cl.
*D01D 11/02* (2006.01)
*D02J 1/20* (2006.01)

(58) Field of Classification Search
CPC ..... B65H 2701/38; D06B 3/02; D06B 3/04; D06B 3/045; D06B 3/208; D06B 5/04; D06B 5/06; D06B 23/025; D06B 23/026
USPC ..... 28/282, 283
See application file for complete search history.

(56) References Cited

U.S. PATENT DOCUMENTS

| | | | | |
|---|---|---|---|---|
| 5,214,828 | A | 6/1993 | Neuert et al. | |
| 6,049,956 | A * | 4/2000 | Lifke | D02J 1/18 28/282 |
| 6,094,791 | A * | 8/2000 | Akase | D02J 1/18 28/282 |
| 6,743,392 | B2 * | 6/2004 | Tanaka | B29B 15/122 28/282 |
| 7,536,761 | B2 * | 5/2009 | Nestler | D02J 1/18 28/282 |
| 2006/0085958 | A1 * | 4/2006 | Oishibashi | D06C 3/00 28/282 |
| 2014/0115848 | A1 | 5/2014 | Miyauchi et al. | |
| 2018/0119317 | A1 * | 5/2018 | Ootsubo | D01D 11/02 |
| 2019/0275705 | A1 * | 9/2019 | Johnston, VII | D01D 11/02 |

FOREIGN PATENT DOCUMENTS

| | | | | |
|---|---|---|---|---|
| CN | 203729003 | U | 7/2014 | |
| CN | 104674485 | A | 6/2015 | |
| EP | 0304361 | A1 | 2/1989 | |
| EP | 2151517 | A1 * | 2/2010 | B29C 70/20 |
| GB | 1068858 | A | 5/1967 | |
| JP | H02251664 | A | 10/1990 | |
| JP | H11117168 | A | 4/1999 | |
| JP | 2002227053 | A | 8/2002 | |
| JP | 2008240233 | A | 10/2008 | |
| JP | 2010084236 | A | 4/2010 | |
| RU | 123415 | U1 | 12/2012 | |
| WO | 0063481 | A1 | 10/2000 | |

OTHER PUBLICATIONS

Chinese Office Action dated May 19, 2021 from counterpart Chinese Patent Application No. 20188009404.3.
International Search Report and Written Opinion dated Jun. 26, 2018 for counterpart PCT Application No. PCT/IB2018/052070.
Japanese Office Action dated Apr. 14, 2022 from counterpart Japanese Patent Application No. 2019-552854.
Korean Office Action dated Apr. 25, 2022 from counterpart Korean Patent Application No. 10-2019-7027450.

* cited by examiner 1
2
3
4
5
6
7
8a
8b
9a
9b
10
10a
12
13
14
14a
14b
15
16
17
A
B
D1
D2
F
P
S1
S2
S3
W1
W2
W3

METHOD FOR SPREADING A TOW OF TEXTILE NON-BRAIDED FILAMENTS, PREFERABLY CHEMICAL OR INORGANIC FILAMENTS

This application is the National Phase of International Application PCT/IB2018/052070 filed Mar. 27, 2018 which designated the U.S.

This application claims priority to Italian Patent Application No. 102017000035017 filed Mar. 30, 2017, which application is incorporated by reference herein.

TECHNICAL FIELD

The present invention relates to a method for spreading a tow of textile non-braided filaments, preferably chemical or inorganic filaments, more preferably carbon fibre filaments.

In particular, the present invention preferably relates to a method for spreading a tow of textile non-braided filaments prior to the winding up thereof to form a coil, or to its direct use in processes that benefit from the increased width of the tow, such as for example systems of pre-impregnation of single-thread sheets ("prepregs").

The present invention hence finds its main application in the manufacture and processing of textile fibres for reinforcing composite materials.

STATE OF THE ART

In fact, the use of tows of reinforcing fibres in composite materials typically involves their homogeneous and oriented distribution in sheets then impregnated with subsequently cured resins. This uniform distribution typically consists of either a 1-24K tow weaving or a side-by-side arrangement of such fibre tows according to predefined directions then crossed in different orientations over successive layers.

K means the quantity in thousands of fibres constituting the tow. 1-, 3-, 6-, 12- or even 24-K tows are defined as "small tows", while larger tows, such as the 48- to 1000-K tows typical of the carbon fibre produced by a textile precursor fibre, are defined as "large tows".

In the prior art, the larger the precursor fibre tow, the cheaper its production. But the final use of a large tow, for example a 320K tow, can certainly not be extended to the weaving of reinforcing sheets that would have excessive thickness, generating waste of material incompatible with the final use. Consequently, the production of these fibre tows is intended for limited final uses where the reinforcing fibre is then cut into very short pieces (chopped), milled or used to create thick felts.

In the prior art, for economic reasons as well as for reasons of stability of the final product, it is therefore difficult to combine the manufacturer's convenience in producing high-count tows with the uniformity and lightness of the sheets which can be obtained starting from the weaving or the placing side-by-side of low-count tows (3-24K), which are more expensive to produce.

For this reason, in fact, systems for fibre processing which can spread/widen the single tow of fibres made by the manufacturer (possibly also in line) have been developed over the years to allow the specific weight of the composite material to be lightened and the above mentioned requirements to be met.

The known solutions are divided into various categories according to the "physical" principle underlying the fibre spreading action, some examples of which are shown below.

A first example is known from US document US2014/0115848, wherein the tow is spread thanks to the action of a plurality of nozzles, which deliver pressurized air transversely to the tow so that the individual air jets pass through it in order to distance the individual fibres from each other.

This method, although functional, is very aggressive to the fibre since it is often very difficult to adjust the power and the consequent and entirely unavoidable turbulence of the air jets in order to optimize the spreading effect without creating undesired interlaces and twists between the individual fibre filaments.

A further solution is known from document U.S. Pat. No. 7,536,761, wherein the spreading of the tow, which is indeed quite limited, is obtained by exploiting the electrical conductivity of the carbon fibre. A voltage applied to the electrodes in contact with the fibre generates a current, which causes the fibre to act as a resistance that heats up very quickly, reducing the "gluing" effect of the sizing applied thereto, which is sensitive to heat. The heated tow, due to the lower cohesion effect between the fibres caused by the hot sizing, spreads more easily.

This methodology, besides allowing very limited spreading of the tow, is complicated to implement and decidedly invasive to the fibre.

Instead, Chinese Document CN203729003 shows a system for spreading the fibre that uses ultrasounds, a solution whose effect is limited and sometimes difficult to control.

Furthermore, Document CN104674485, instead, shows a bundle-spreading system acting mechanically on the fibre, by calendering, which, as known, can significantly affect the quality and performance of the fibre due to the mechanical action and friction generated between the calenders and the fibres themselves.

Object of the Invention

Therefore, the object of the present invention is to provide a method for spreading a tow of textile non-braided filaments, preferably chemical or inorganic fibre filaments, which is capable of obviating the drawbacks of the prior art.

In particular, the object of the present invention is to provide a method for spreading a tow of textile non-braided filaments, preferably chemical or inorganic fibre filaments, which is highly effective and not very aggressive to the fibres/filaments.

Still a further object of the present invention is to provide a method for spreading a tow of textile non-braided filaments, preferably chemical or inorganic fibre filaments, which can be easily implemented and allows reduced energy consumption.

Said objects are achieved by means of a method for spreading a tow of textile non-braided filaments, preferably chemical or inorganic fibre filaments, which has the technical features of one or more of the subsequent claims.

In particular, this method comprises providing a tow of textile non-braided filaments extending along its own main direction.

It should be noted that the expression "textile non-braided filaments" is intended to mean that the tow is "not woven", i.e. the filaments are placed side by side and mechanically/structurally unbound (they could be chemically bound by means of a sizing agent, to be removed during the execution of the method, as will be explained below).

The section transverse to the main direction of this tow has a predetermined thickness and a predetermined width (i.e. the initial thickness and width).

Preferably, the predetermined width or initial width is equal to at least 1 cm.

The tow is fed along a travel path, then spread in order to increase its width and reduce its thickness, thus defining a spread tow, and subsequently extracted from the bath.

According to one aspect of the present invention, the spreading step comprises immersing the tow in a bath; preferably, the bath is an aqueous bath in which the tow is immersed.

Advantageously, in this way, the filaments are kept in an atraumatic and lubricated environment, so that any tow spreading movement is not very aggressive to the filaments and does not damage them.

Preferably, a sequence of waves defining transverse flows, which cross the tow transversely to the main direction, is generated in the bath, in order to translate and place the individual filaments side by side, thereby permanently spreading the tow.

In other words, an ordered and pulsating turbulence is generated in the vicinity of the tow, inside the bath, so that the liquid passes several times through the tow itself in two opposite directions, causing this passage to induce the displacement of the filaments and the spreading of the tow.

According to one aspect of the invention, the tow entering the bath and/or the spread tow extracted from the bath is/are unsized.

In other words, the tow spreading step is carried out on an unsized (or partially sized) tow.

Preferably, the generation of the waves is obtained by stirring the bath in the vicinity of the tow.

Advantageously, since the waves that hit the tow are generated in the vicinity of the tow itself, they are strongly localized and high-powered (with regard to the application).

In this regard, the step of generating the sequence of waves preferably comprises generating, alternately, a succession of first waves crossing the tow in a first direction, and a succession of second waves crossing the tow in a second direction opposite the first.

Clearly, in order for their action to "spread" the tow, both (first and second) directions are transverse to both the main direction and the width of the tow.

Preferably, the tow is fed along the travel path on a support provided with a plurality of through holes.

The first waves are therefore preferably generated by pumping the liquid (of the bath) exiting said holes along said first direction (i.e. by generating an overpressure on the opposite side of the hole with respect to the tow).

Similarly, the second waves are generated by sucking up the liquid entering said holes along said second direction (i.e. by generating a negative pressure on the opposite side of the hole with respect to the tow).

BRIEF DESCRIPTION OF THE DRAWINGS

Further features and the related technical advantages will become more apparent from the following illustrative, therefore not limiting description of a preferred, thus not exclusive embodiment of a method and an apparatus for spreading a tow of textile non-braided filaments, preferably chemical or inorganic fibres, as illustrated in the accompanying figures, in which.

DETAILED DESCRIPTION OF PREFERRED EMBODIMENTS OF THE INVENTION

Figures 1, 1A:
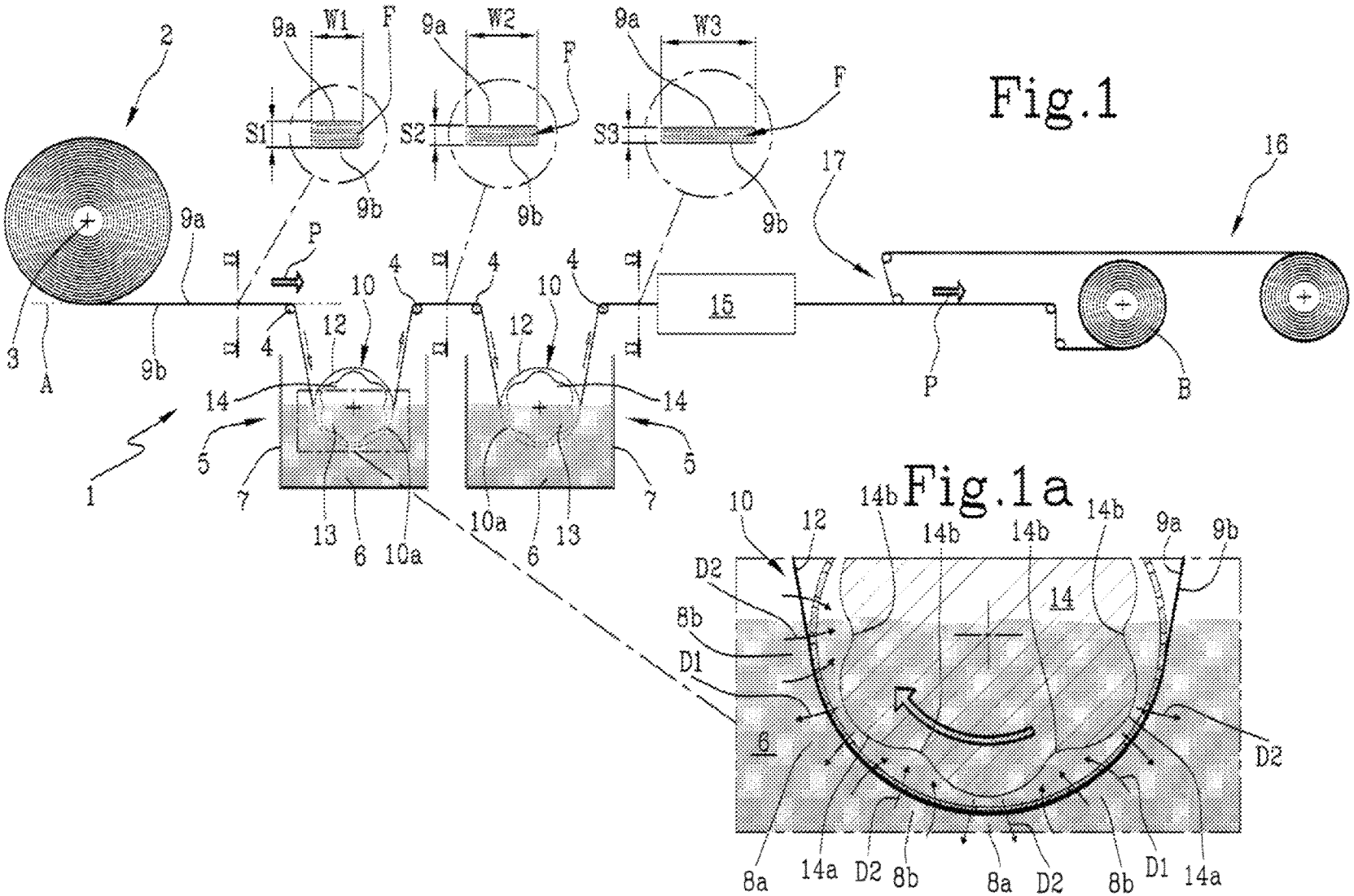
FIG. 1 shows a schematic representation of an apparatus for spreading a tow of textile non-braided filaments during the implementation of the method according to the present invention.
FIG. 1*a* shows a detail of FIG. 1.
Figure 2:
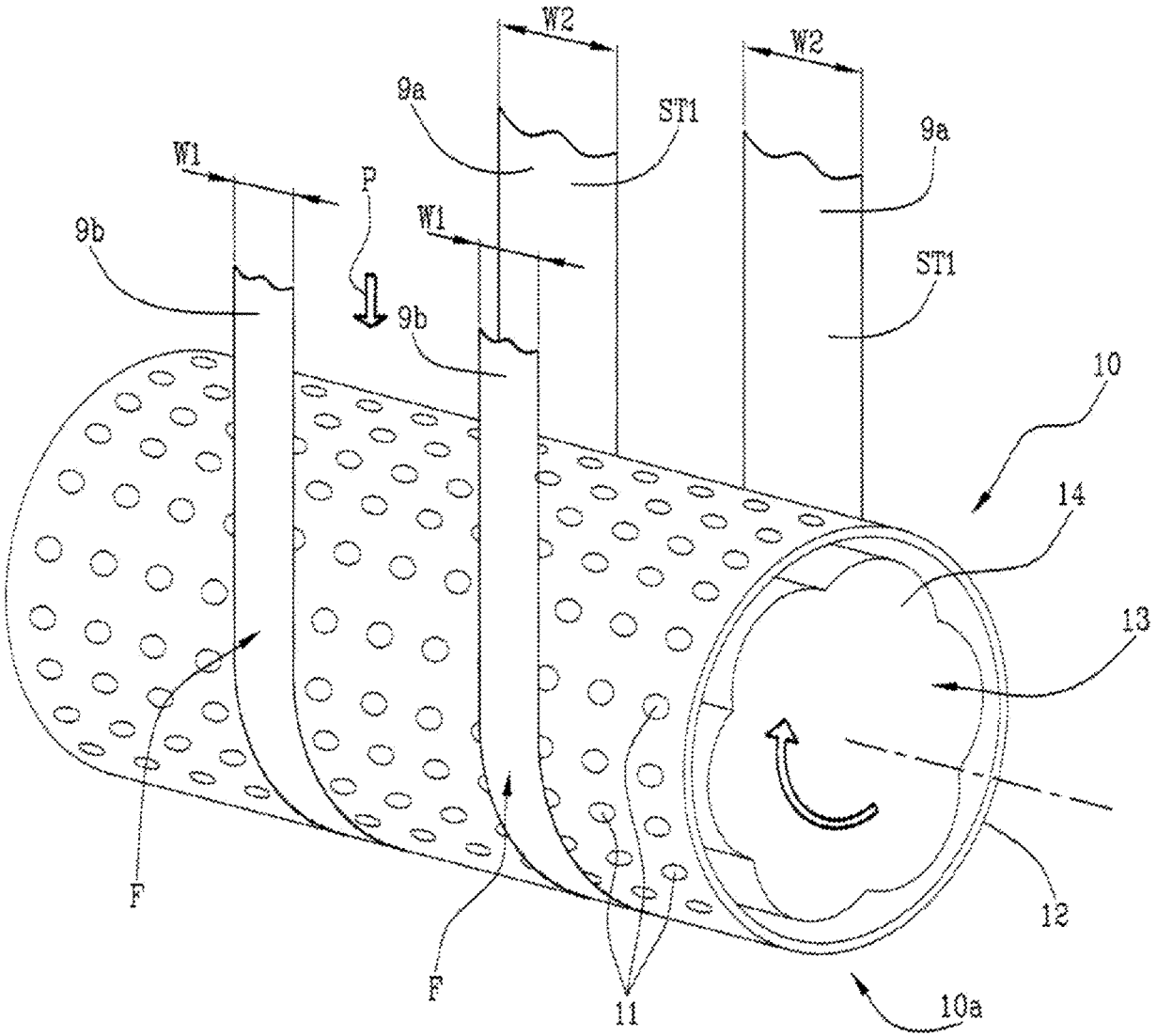
FIG. 2 shows a schematic and perspective view of a detail of the apparatus of FIG. 1.

With reference to the attached figures, numeral 1 indicates an apparatus for spreading a tow F of textile non-braided filaments adapted to implement the method according to the present invention.

In this text, the expression "textile filaments" is intended to define the set of fibrous products which, due to their structure, length, strength and elasticity, have the ability to combine with each other, through spinning, into thin, tenacious and flexible threads that are used in the textile industry for the manufacture of tows or yarns, which in turn, by weaving and/or resin finishing processes, are transformed into fabrics and/or processed to make composite materials.

It should be noted also that the term "non-braided" is intended to mean that the tow consists of filaments that are substantially placed side by side/parallel to each other, neither interwoven nor twisted or woven, so that they are substantially unbound from a structural/mechanical point of view.

Preferably, the method according to the present invention finds application in the processing of chemical or inorganic fibre filaments.

According to the present text, "chemical fibres" (or technofibres) are to be regarded as all the fibres of a chemical nature, whether they are artificial or synthetic, such as for example cellulose, polyolefin, aramid, polyamide, polyester, polyvinyl, polyacrylic fibres, etc.

In this text, on the other hand, "inorganic fibres" is intended to classify those fibres produced from minerals or inorganic substances, such as for example glass fibre, metallic fibres, metallised fibres and carbon fibre.

In particular, indeed, the method according to the present invention finds its main and preferred application in the processing of carbon fibre.

The method thus comprises providing a tow F of textile non-braided filaments extending along its own main direction A.

As said, the initially provided tow F is unsized.

The tow F has a section (schematically illustrated in FIG. 1) transverse to the main direction A with a predetermined thickness "s1" and a predetermined width W1, W2, W31.

Preferably, said predetermined width (or initial width) is equal to at least 1 cm. This value preferably corresponds to a 48K-count tow F, the lower limit below which the method according to the invention reduces its effectiveness (albeit without eliminating it).

It should be noted that the term "tow" is intended to define a set of individual filaments (or fibres) placed side by side/grouped together so as to define a single element that can be handled by the operator; the cross-sectional distribution of the individual filaments (or individual fibres) thus defines the thickness s1, s2, s3 and the width W1, W2, W3 of the above described cross-section.

It should be noted that the step of providing the tow F preferably comprises providing a coil 2 consisting of the tow F itself wound around a winding axis on a suitable support 3.

The coil 2 is thus rotatable relative to the support 3 about the aforementioned winding axis, so that it can "unwind".

Once placed, the tow F is then fed along a predetermined travel path P.

The feed is preferably performed by unwinding the coil 2, which has a weight preferably comprised between 40 and 500 kg, and passing the tow F through a series of return rollers and tensioning means 4, which keep it in traction to allow it to advance.

A second feeding method, instead, comprises the use of a container in which the tow F is arranged in an orderly, zigzag fashion until said container is filled. The container is generally used when the tow exceeds 24K and has large dimensions (e.g. approximately 1 m×1 m×1.5 m).

According to one aspect of the invention, the tow F undergoes a spreading or widening action along the travel path M through a special spreading station 5.

The aforesaid spreading step has the purpose of increasing the width W1 of the tow F, while reducing its thickness s1, so as to obtain a spread tow with a W2 width and an s2 thickness.

Preferably, the spreading steps performed in the method are more than one, in succession; in the preferred embodiment, the spreading steps (and therefore the spreading stations 5) are at least two, arranged in succession.

In this embodiment, therefore, the first spreading station 5 brings the tow F from the width W1 to the (larger) width W2 and from the thickness s1 to the (smaller) thickness s2, providing the spread tow ST1.

The second spreading station 5 brings the tow F from the width W2 to the width W3 (larger than W2) and from the thickness s2 to the thickness s3 (smaller than s2), providing the spread tow ST2.

In other embodiments, however, the spreading steps may also be more than two.

Quantitatively, preferably, each spreading operation leads to an extension of the width at least equal to or greater than 50% of the initial width.

More precisely, the widening (in the first/second step) ranges from 3 to 20 times the initial width, while the subsequent steps can be more effective in uniformly redistributing the thickness of the tow even with the same overall width.

It should be noted that the spreading steps are preferably carried out in "direct" succession, i.e. without other operations, other than return operations, being performed on the tow F.

In this light, the spreading stations 5 are preferably immediately adjacent to one another.

In other words, the first spreading station 5 is arranged immediately upstream of the second spreading station 5.

Therefore, the only devices (optionally) present between the two spreading stations 5 are return rollers or feeding members, but, preferably, no mechanical, chemical or thermal operation is performed between one spreading and the next.

It should be noted that it is also possible to introduce a tension control based on a plurality of motorised rollers in order to better control the width of the tow.

With reference to the spreading step, according to one aspect of the present invention, first of all it comprises immersing the tow F in a bath 6, preferably an aqueous (i.e. water-, preferably demineralized water-based) bath, and generating a sequence of transverse waves 8*a*, 8*b*, crossing the tow F transversely to the main direction A in order to obtain a spread tow ST1, ST2.

Subsequently, the spread tow ST1, ST2 is extracted from the bath 6.

According to one aspect of the invention, the tow F entering (or immersed in) the bath 6 and/or the spread tow ST1, ST2 extracted from the bath 6 is/are unsized.

The term "unsized" refers to the so-called unsized, i.e. devoid of sizing (or sizing agent or gluing agent), condition of the filament or tow, which is used in the textile and carbon fibre processing industry to facilitate subsequent steps of resin finishing of the tow F.

Therefore, the tow F in the bath can be the result of a sized tow from which the bath 6 removes the size, an unsized tow to which the bath 6 applies the size or an unsized tow in a bath devoid of sizing.

Therefore, what is important is that during the bath the tow is not fully sized.

In this way, since the tow F is not fully sized (i.e. unsized), the filaments can freely move relative to each other and therefore the spreading step comprises physically and "rigidly" translating the filaments so as to place them side-by-side.

Structurally, the bath 6 is preferably defined by one or more tanks 7, each filled with a predetermined quantity of liquid (preferably with said emulsion).

The tow F is plunged into the tank 7 (or tanks) by means of a traction return system (i.e. rollers) and the spreading is carried out inside the bath 6.

Preferably, in fact, a sequence of transverse waves 8*a*, 8*b* crossing the tow F transversely to the main direction A is generated in the bath 6.

In other words, the method comprises generating in the bath 6 a plurality of liquid flows or currents crossing the tow F (i.e. transverse to the tow F) in order to separate and place the individual filaments side by side.

Advantageously, the hydraulic action of the waves/currents allows a highly effective and at the same time not very traumatic/aggressive separation of the filaments, thus optimizing the performance and succeeding in minimizing the problems of the prior art.

Preferably, in order to obtain the sequence of waves 8*a*, 8*b*, the bath 6 is is stirred in the vicinity of the tow F (or of the area of passage of the tow (F).

In other words, turbulence is generated at the tow F so that the aforementioned waves 8*a*, 8*b*, which cross the tow F in mutually opposite directions to separate the filaments, are generated.

It should be noted that, since the generation of waves is suitably controlled, the turbulence that is imparted is ordered, i.e. defined by a sequence of waves 8*a*, 8*b* appropriately localized and directed, and pulsed, i.e. such that each portion of the tow F is subjected to the action of waves which are cyclically differently directed.

More precisely, the step of generating the waves 8*a*, 8*b* comprises generating, alternately, a succession of first waves 8*a* crossing the tow F in a first direction D1, and a succession of second waves 8*b* crossing the tow F in a second direction D2.

The second direction D2 is substantially opposite to the first D1; both directions (first D1 and second D2) are transverse to the main direction A and the width W1, W2, W3 of the tow F.

In other words, the tow F has a first 9*a* and a second face 9*a* opposite to each other.

The first waves 8*a* cross the tow F from the first 9*a* to the second face 9*b*.

The second waves 8*b* cross the tow F from the second 9*b* to the first face 9*a*.

Preferably, in order to "stir" the bath 6, the spreading station 5 comprises a suitable stirring device 8.

Such stirring device 8 comprises at least one support 10 provided with a plurality of through holes 11 on which the tow F is fed.

More precisely, the support 10 is at least partly embedded in the bath 6 and the tow F is at least abutted against it at one immersed portion thereof 10*a*.

In other words, the first face 9*a* of the tow F is abutted against the support 10 at one immersed portion thereof 10*a*.

In use, the tow F is fed along the travel path P above the support 10; preferably, the support and the tow F are integral with each other.

In the preferred embodiment, in fact, it is the tow F that moves the support 10 by dragging it as it advances along the travel path P.

Preferably, the support 10 is defined by a rotating drum 12 that is rotatable about an axis transverse, preferably orthogonal, to the main direction of the tow F.

In the preferred embodiment, the axis of rotation of the drum 12 is parallel to the axis of unwinding of the coil 2.

Advantageously, in this way, forces do not arise which tend to slide the tow filaments wound on the drum 12 transversely thereto.

Preferably, in order to generate the first 8*a* and second waves 8*b*, the method comprises, respectively, pumping the bath liquid exiting the holes 11 along the first direction D1 and sucking up the bath liquid entering said holes 11 along said second direction D2.

Therefore, the step of pumping the liquid causes a first wave 8*a* or a stream of fluid to exit the hole 11 and then pass through the tow from the first face 9*a* (abutted against the support 10) to the second face 9*b*.

On the contrary, the suction step causes a second wave 8*b* or a stream of fluid distal to the support 10 with respect to the tow F (i.e. radially external with respect to the drum 12), to pass through the tow F itself from the second face 9*b* to the first face 9*a*, then back into the hole 11.

In other words, in the spreading station 5, the support 10 is interposed between the tow F and a stirrer member 13 configured to pump the fluid in the first direction D1 out of a respective hole 11 and suck up the fluid along the second direction D2 from a further hole 11.

Preferably, in the same moment in time, first 8*a* and second waves 8*b* are simultaneously generated at different portions of the tow F in contact with the support 10.

In the preferred embodiment, therefore, the stirrer member 13 is located inside the drum 12.

Therefore, the first D1 and the second direction D2, respectively, have a main component oriented radially outwardly and a main component oriented radially inwardly.

In use, therefore, the step of generating the sequence of waves 8*a*, 8*b* comprises:

- feeding the tow F along the travel path P by partly winding it on a rotating drum 12;
- generating a plurality of first waves 8*a* and second waves 8*b* by pumping the liquid exiting the holes 11 of the drum 12 (along said first direction (D1) and sucking up the liquid entering said holes 11 (along said second direction (D2).

It should be noted that, preferably, in the same moment in time, the method comprises generating:

- a plurality of first waves 8*a* angularly spaced along the drum 12 (exiting a plurality of holes 11) and
- a plurality of second waves 8*b* angularly spaced along the drum 12 and out of phase with respect to the first waves 8*a* (exiting a different plurality of holes 11).

In the preferred embodiment, the stirrer member 13 comprises a lobed roller 14 arranged inside the drum 12 and rotatably associated therewith; preferably, the lobed roller 14 is coaxial with the drum 12.

"Lobed roller" 14 is intended to define a roller that extends circumferentially along its periphery with a plurality of grooves 14*b* and apexes 14*a*, which are preferably at least partly rounded.

In order to generate the first 8*a* and second waves 8*b*, the lobed roller 14 is rotated in the drum 12 with a rotation speed different from that of the drum 12, preferably in counter-rotation.

In this way, when an apex 14*a* passes next to a hole, it tends to pump the fluid out of the same (first wave 8*a*), which at the same time generates a negative pressure at the adjacent hole facing a groove 14*b*, where a second wave 8*b* is created.

Alternatively, it should be noted that the stirrer member may also have a different shape, such as for example that of a roller which is eccentric with respect to the drum or an array of stirring elements arranged at the inner periphery of the drum.

Advantageously, this allows the generation of a turbulent motion located in the vicinity of the tow F in a simple and very cheap way, as no pneumatic blowing or pumping systems or heating systems are necessary, but simply a rotary actuation system (only the lobed roller 14, the drum 12 being preferably idle).

Preferably, in a first embodiment wherein the tow F is initially unsized, the method also comprises the step of sizing the tow F.

This sizing step is performed simultaneously or following said spreading step.

More preferably, the sizing step is performed in the bath 6.

In this regard, the bath 6 is preferably defined by a water-based liquid containing a sizing agent. In the preferred embodiment, the bath 6 is preferably made with an emulsion of (demineralized) water and resin (a limited quantity), preferably epoxy resin.

Advantageously, in this way, the bath (i.e. emulsion) defines the sizing (or base layer) for the tow F, on which a resin is then (in subsequent processes) preferably deposited, which will make it suitable for use as a composite material.

Alternatively, the tow F may initially be sized, mainly for facilitating its handling qualities.

In this case, the bath 6 preferably comprises a solvent suitable to remove the size, allowing the widening of the filaments.

It should be noted that the two embodiments described above can be complementary, i.e. comprise a sizing step upon removal of the size by a solvent.

Preferably, a step of drying the spread tow FT1, ST2 is further provided after the spreading.

The drying step is preferably carried out in a suitable drying station or oven 15 operatively arranged downstream of the spreading station(s) 5, as shown schematically in FIG. 1.

Lastly, a step of winding the spread tow ST2 is preferably provided in order to achieve a widened coil C, which can be easily stored by the manufacturer.

In this regard, it should be noted that a step of coupling the spread tow ST2 with a sheet or film 16 of material is preferably provided and operatively performed before said winding step.

Thus, the spreading device 1 preferably comprises a coupling station 17 configured to carry out said operation.

The invention achieves the intended objects and attains important advantages.

In fact, performing the spreading of the tow by means of a localized (and distributed) hydraulic turbulence allows excellent results in terms of tow spreading without however generating excessive stress or fibre breakage.

In fact, the purely hydraulic action of the waves in an underwater environment makes it possible to exploit the great strength of the hydraulic currents in conjunction with the typical damping of the actions in this type of environment.

The invention claimed is:

1. A method for spreading a tow of textile filaments, comprising the following steps:

providing a tow of textile filaments placed side by side and mechanically unbound, the tow extending along a main direction and having a section transverse to said main direction with a predetermined thickness and a predetermined width of at least 1 cm;

feeding the tow along a travel path;

spreading the tow in order to increase its width and reduce its thickness, defining a spread tow;

wherein the step of spreading the tow comprises:

immersing the tow of textile filaments in a bath;

generating in the bath a sequence of transverse waves crossing the tow transversely to the main direction in order to translate and place the filaments side by side, thereby permanently spreading the tow;

extracting the spread tow from said bath;

wherein the tow entering the bath and/or the spread tow extracted from the bath is/are unsized;

wherein the step of generating the sequence of waves comprises:

feeding the tow along the travel path on a support provided with a plurality of through-holes;

generating, alternately, a succession of first waves crossing the tow in a first direction and a succession of second waves crossing the tow in a second direction opposite the first direction; both the first direction and the second direction being transverse to the main direction and to the width of the tow;

wherein the generating of the first waves comprises pumping a liquid exiting the through-holes along the first direction; and wherein the generating of the second waves comprises sucking up a liquid entering the through-holes along said second direction.

2. The method according to claim 1, wherein said step of generating the sequence of waves is carried out by stirring the bath in a proximity of the tow.

3. The method according to claim 1, wherein said step of generating the successions of the first waves and the second waves comprises feeding the tow along the travel path by partly winding it on a rotating drum, said drum including on an outer surface thereof, the plurality of through-holes.

4. The method according to claim 3, wherein said generating of the successions of the first waves and the second waves is carried out by rotating a lobed roller inside the drum with a rotation speed different from that of the drum.

5. The method according to claim 2, and further comprising a plurality of said spreading steps carried out in succession; each spreading step comprising the immersion in the bath and the generation of the succession of first and second waves.

6. The method according to claim 1, and further comprising a step of providing a coil constituted by said tow of textile filaments wound around a winding axis; said step of feeding the tow being carried out by unwinding said coil.

7. The method according to claim 1, and further comprising a step of drying the spread tow following said spreading step.

8. The method according to claim 1, and further comprising a step of winding the spread tow to provide a spread coil.

9. The method according to claim 8, and further comprising a step of coupling the spread tow with a sheet or film of material, which is operatively performed before said winding step.

10. The method according to claim 1, wherein said tow entering the bath is unsized; said method comprising a step of sizing the tow carried out simultaneously or following said spreading step.

11. The method according to claim 10, wherein said bath is defined by a water-based liquid containing a sizing agent, in order to carry out said step of sizing the tow simultaneously with the spreading step.

12. The method according to claim 11, wherein said water-based liquid is an emulsion of demineralized water and a resin.

13. The method according to claim 12, wherein said resin is an epoxy resin.

* * * * *